US005413006A

United States Patent [19]

D'Autry

[11] Patent Number: 5,413,006

[45] Date of Patent: May 9, 1995

[54] PIPETTE FOR SAMPLING AND DISPENSING ADJUSTABLE VOLUMES OF LIQUIDS

[75] Inventor: Eric M. D'Autry, Paris, France

[73] Assignee: Gilson Medical Electronics (France) S.A., France

[21] Appl. No.: 128,370

[22] Filed: Sep. 28, 1993

[30] Foreign Application Priority Data

Sep. 28, 1992 [FR] France ..... 92 11529

[51] Int. Cl.[6] ..... B01L 3/02

[52] U.S. Cl. ..... 73/864.18

[58] Field of Search ..... 73/864.13, 864.18; 422/100; 222/309

[56] References Cited

U.S. PATENT DOCUMENTS 4,141,250 2/1979 D'Autry .
4,395,921 8/1983 Oppenlander .
4,501,163 2/1985 MacDermott et al. ..... 73/864.18
4,672,857 6/1987 MacDermott .
5,018,394 5/1991 Gilson .

FOREIGN PATENT DOCUMENTS 2203680 5/1974 France .
0640152 12/1983 Switzerland ..... 422/100

*Primary Examiner*—Robert Raevis

[57] ABSTRACT

A pipette body extends along a longitudinal axis and a piston mounted in sliding fashion along this axis inside the said pipette body so as to define a chamber of variable volume emerging at a sampling orifice, said piston being driven over a limited distance of travel in the direction of the sampling orifice by means of pressure manually exerted on a push rod mounted in sliding fashion in the pipette body, and in the opposite direction by the reaction of elastic return means until it abuts against an axial extremity of a metal sheath extending along the said longitudinal axis in side the pipette body. The sheath has an external thread which works by engaging with a thread inside the pipette body in such a way as to move the sheath longitudinally when driven in rotations, in order to adjust the distance of travel of the piston in the opposite direction and the volume of the chamber.

16 Claims, 3 Drawing Sheets

PIPETTE FOR SAMPLING AND DISPENSING ADJUSTABLE VOLUMES OF LIQUIDS

BACKGROUND OF THE INVENTION

1. Field of the Invention

The present invention relates to an improvement to a pipette for sampling and dispensing adjustable volumes of liquids.

2. Background Information

The invention relates more particularly to an improvement to a pipette of the type comprising a pipette body extending along a longitudinal axis and a piston mounted in sliding fashion along this axis inside the said pipette body so as to define a chamber of variable volume emerging at a sampling orifice, said piston being driven over a limited distance of travel in the direction of the sampling orifice by means of pressure manually exerted on a push rod mounted in sliding fashion in the pipette body, and in the opposite direction by the reaction of elastic return means until it abuts against an axial extremity of a metal sheath extending along the said longitudinal axis inside the pipette body. The sheath has an external thread which works by engaging with a thread inside the pipette body in such a way as to move the sheath longitudinally when driven in rotation, in order to adjust the distance of travel of the piston in the opposite direction and the volume of the chamber. Moreover, the sheath is capable of being driven in rotation by a fine adjustment knob integral with the sleeve, and intermeshes with means for displaying the volume to be dispensed. The push rod is mounted in sliding fashion in the sleeve.

In this type of pipette, the volume to be dispensed is usually adjusted with the aid of thumb and forefinger. These two fingers are applied on opposite sides of the fine adjustment knob accessible via windows on opposite sides of the pipette body. While the fine adjustment knob makes it possible to precisely adjust the volume to be dispensed, it can be turned over only a limited angle of rotation on each action of thumb and forefinger, this distance being related to the width of the windows provided on the pipette body. Now, the operator using the pipette will, in certain cases, have to successively dispense widely-differing volumes, and in order to set these values on the pipette, the sheath has to be driven in rotation a large number of times calling for the knob to be operated many times by thumb and forefinger. Beside the drawback of the tedious manner in which the pipette is adjusted to widely-differing values, if operators are wearing gloves, the skin of the gloves often snags and tears in the clearance provided between the knob and the edge of the windows provided on the pipette body.

SUMMARY OF THE INVENTION

The object of this invention is a perfected pipette which overcomes the above-mentioned drawbacks, and which is in particular easy to adjust by an operator wearing gloves and can be rapidly adjusted to the volume to be dispensed.

According to a first embodiment of the invention, the push rod has a non-symmetrical cross-section of revolution over at least a portion of its length, the sheath being rigidly locked by locking means to a sleeve arranged coaxially with respect to the sheath and in which the portion of the push rod of non-symmetric cross-section of revolution is also engaged. The internal profile of the sleeve is complementary or homologous to the said portion of the push rod so as to rigidly lock the push rod and sheath in rotation while allowing the push rod to move longitudinally inside the sheath to provide rapid adjustment of the volume to be dispensed.

Preferably, the sleeve is glued inside the sheath.

In a preferred embodiment of the invention, the sleeve is received in a bore emerging on the axial extremity of the sheath serving as a distance of travel end stop in the reverse direction of the piston, the radially external face of the sleeve having hollowings to house fixing glue in the bore of the sheath.

According to one advantageous embodiment of the invention, the push rod has a portion located outside the pipette body having a button comprising a rapid adjustment knob with means for rigidly locking it in rotation with the said push rod and a cover mounted free in rotation about the said longitudinal axis which covers the axial extremity section of the knob located opposite the pipette body.

Preferably, the means for rigidly locking the rapid adjustment knob in rotation with the push rod comprise two longitudinal slots formed on two diametrically opposed sides of the push rod and which engage with two projecting ribs of complementary profile on the bearing surface of the rapid adjustment knob.

In a first embodiment, the cover is mounted free in rotation on the push rod and held axially onto it by complementarity of shapes.

In a second embodiment, the cover is mounted free in rotation on the fast adjustment knob and held axially on it by complementarity of shapes.

BRIEF DESCRIPTION OF THE DRAWINGS

A full understanding of the other characteristics and advantages of this invention can be gained from the following non-limiting, detailed description of one embodiment of the invention when read in conjunction with the attached drawings in which.

DESCRIPTION OF THE PREFERRED EMBODIMENTS

Figures 1, 2:
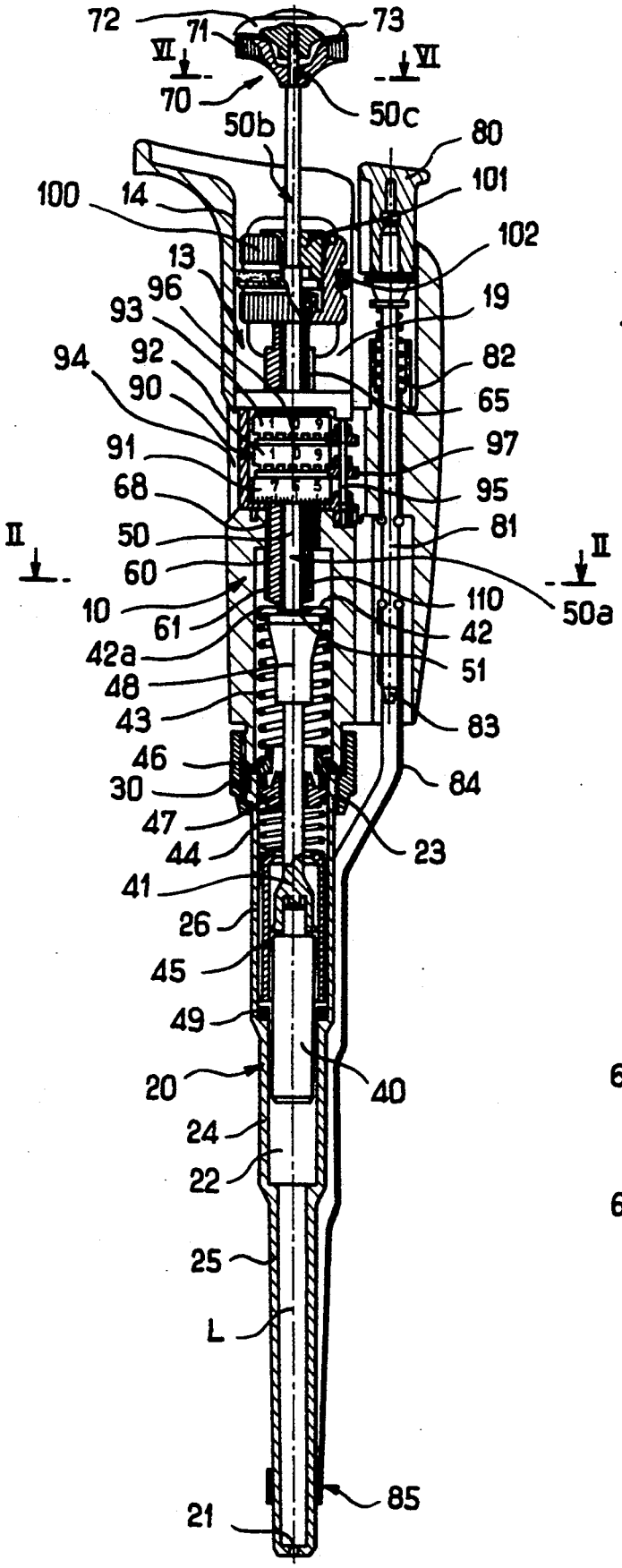
FIG. 1 is an overall longitudinal cross-sectional view of a pipette according to the invention.
FIG. 2 is a partial transverse view along the line II—II in FIG. 1.

In accordance with the invention, the pipette shown in FIG. 1 is symmetrical with respect to a median plane corresponding to the section of FIG. 1. The pipette comprises a pipette body extending along the direction of a longitudinal axis L contained in the above-mentioned median plane, made up of a casing 10 and a sampling tube 20 which are connected in removable fashion by a nut 30 engaged on sampling tube 20 and which engages with an external thread provided on casing 10. Sampling tube 20, symmetrical in revolution about longitudinal axis L, has, from its upper extremity, adjacent to casing 10, a succession of staggered inner walls 26, 24, 25 defining three respective pipes of decreasing diameters. Sampling tube 20 receives a piston 40 which is mounted in sliding fashion inside the said tube. With the pipes formed by the three staggered walls 24 and 25, piston 40 defines a chamber 22 of variable volume emerging at an orifice 21 located at the lower extremity of sampling tube 20. The lower extremity of sampling tube 20 receives, in removable fashion, a disposable tubular nozzle (not shown) communicating in a sealable manner with sampling orifice 21 and which is intended to contain and then dispense the liquid to be sampled. This nozzle is held by friction on the outer surface of wall 25 of sampling tube 20. Sampling tube 20 has a radial flange 23 at its upper extremity which bears against nut 30.

Piston 40, preferably made up of a metal cylinder of diameter corresponding to that of the pipe formed by wall 24, is integral with the lower extremity of a piston rod 41 mounted in sliding fashion in the pipette body. Piston rod 41 has an enlarged cylindrical portion 48 at its upper extremity, the extremity section 42 of which serves as a bearing surface for an extremity 51 of a push rod 50, as will be seen in the description that follows. Extremity section 42 is radially bordered on its periphery by a projecting radial flange 42*a*. Piston 40 is driven in the direction of sampling orifice 21 under the action of pressure manually exerted on push rod 50 mounted in sliding fashion in casing 10, the extremity of push rod 50 opposite that which bears on section 42 having a button 70 for this purpose. Piston 40 is returned by displacement in the opposite direction by the reaction of springs 43 and 44 acting on piston rod 41 and the pipette body, until it abuts against an axial extremity 61 of a metal sheath 60 mounted inside casing 10, and inside which the above-mentioned push rod 50 moves freely in longitudinal sliding fashion.

Sheath 60 has a threaded outer surface which works by engaging with a thread 68 on the inside of casing 10 such that when sheath 60 is driven in rotation about longitudinal axis L, it is displaced along this axis and consequently adjusts the distance of travel of piston 40 in the opposite direction, therefore adjusting the volume of sampling chamber 22. More precisely, piston rod 41 passes through two washers 46 and 47 located in the pipette body, washer 46 being held fixed in the pipette body by the clamping of its periphery between the adjacent extremities of casing 10 and sampling tube 20, washer 47 being mounted in sliding fashion along piston rod 41 between washer 46 and piston 40 in the pipe formed by wall 26 of sampling tube 20. Spring 43 is arranged in casing 10 around piston rod 41, one extremity of said spring abutting at the enlarged cylindrical portion 48 against radial flange 42*a*, and the other extremity against washer 46. Spring 44 is mounted around piston rod 41 and is axially interposed between washer 47 and an axial extremity of a bushing 45 placed in the pipe formed by wall 26 between this wall 26 and piston 40, the other axial extremity of this bushing 45 abutting, via an O-ring 49, against the transverse shoulder delimiting staggered walls 24 and 26. The diameter of the enlarged cylindrical portion 48 of piston rod 41 is smaller than that of the hole in washer 46 but larger than the diameter of the hole in washer 47, such that it can pass through washer 46 when push rod 50 drives piston rod 41 and then compress spring 44 by abutting on washer 47. The stiffness constant of spring 44 is substantially larger than that of spring 43 in such a way as to delimit two successive distances of travel of the piston for the operator pressing on button 70, a first distance of travel corresponding to the compression of spring 43 until enlarged cylindrical portion 48 of piston rod 41 abuts against washer 47 and to the variation of the volume of chamber 22 of the quantity to be sampled or dispensed, and a second more forceful distance of travel corresponding to the compression of spring 44. This latter distance of travel serves to purge any remaining drops of liquid retained by capillarity in the disposable nozzle.

As shown in the transverse cross-section in FIG. 2, sheath 60 has, longitudinally, a slot 65 on its external surface for intermeshing with display means 90 which display the dispensed volume. More precisely, these display means 90, housed in casing 10, comprise a units wheel 91, rigidly locked in rotation with sheath 60, and tens 92 and hundreds 93 wheels driven by the units wheel 91 by intermeshing teeth 96 provided on the wheels and by ratchets 97 mounted on a shaft 95 parallel to axis L, in a way known in itself and which will not be described in greater detail. A transparent window 94 is provided in casing 10 so that the operator can read the volume to be dispensed.

Sheath 60 has, at its axial extremity opposite extremity 61 serving as an end stop for section 42, a fine adjustment knob 100, rigidly locked in rotation with sheath 60. Knob 100 is situated inside a housing 13 provided in casing 10, and emerges at two access windows 19 via which knob 100 can be operated from outside casing 10. Knob 100 has a locking ring 102 housed in an annular groove provided on the periphery of knob 1 00 which forms a break against wall 14 of housing 13.

The pipette is also provided with means for ejecting the nozzle after sampling and dispensing a liquid. Preferably, these ejection means comprise, as shown, a button 80 mounted in sliding fashion in casing 10 so as to drive a rod 81 towards sampling orifice 21, said rod 81 being returned in the opposite direction by the reaction of a return spring 82, free extremity 83 of this rod 81 receiving, by friction fitting, a curved blade 84. The transverse cross-section of curved blade 84 is in the form of a portion of a circle centered about longitudinal axis L, curved blade 84 substantially marrying with the external shape of sampling tube 20. The blade 84 is terminated at its free extremity 85 by two projecting transverse elements curved around the extremity of the sampling tube 20 serving to guide the sliding of blade 84 along tube 20 and to press on the extremity section of a disposable nozzle engaged on tube 20 in order to eject it.

According to an advantageous embodiment of the invention, push rod 50 is staggered along its length to form three portions 50*a*, 50*b*, 50*c* of decreasing respective diameters, extending successively from extremity 51 of push rod 50 acting on section 42 up to push button 70.

More precisely, the largest-diameter portion, portion 50*a*, extends from extremity 51 over a length longer than that of sheath 60 up to approximately mid-length of fine adjustment knob 100. Portion 50*a* is retained in sliding fashion in the sheath and in knob 100 by the abutment of the transverse shoulder delimiting portions 50*a* and 50*b* of push rod 50 on the lip of a retaining ring 101 housed in knob 100, the inside diameter of said retaining ring 101 being larger than the diameter of portion 50*b* but smaller than the diameter of portion 50*a*. Preferably, portion 50*b* has a cylindrical cross-section of revolution about longitudinal axis L.

The smallest-diameter portion, portion 50*c*, carries button 70.

Figure 3:
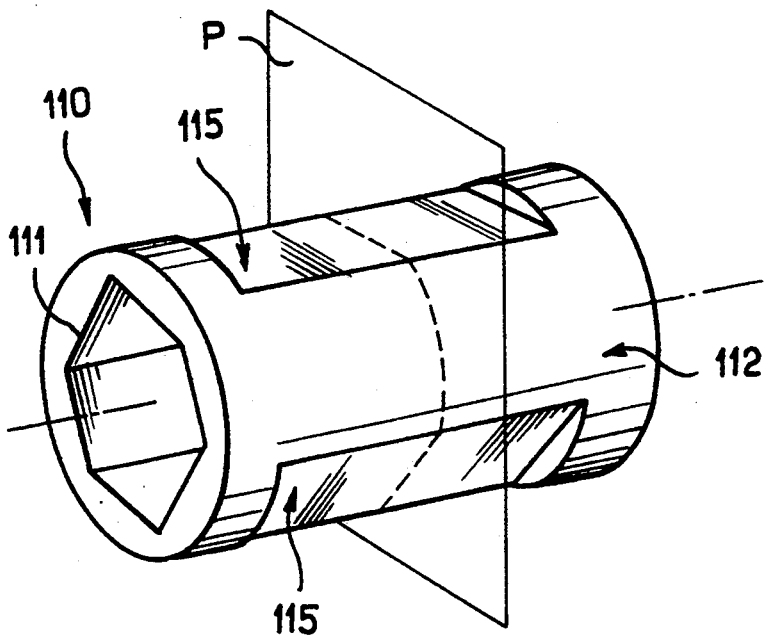
FIG. 3 is a perspective view of a sleeve according to the invention.
Figure 4:
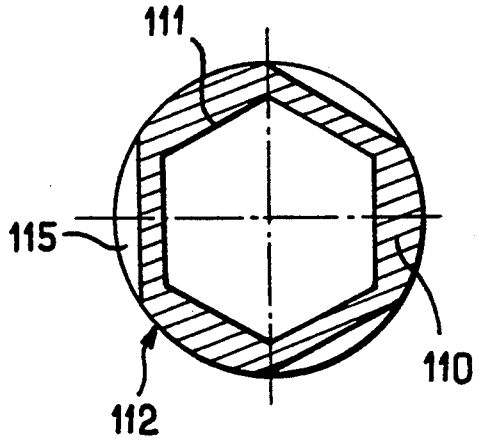
FIG. 4 is a cross-sectional view along a median plane of symmetry for the sleeve shown in FIG. 3, perpendicular to the longitudinal axis of said sleeve.
Figure 5:
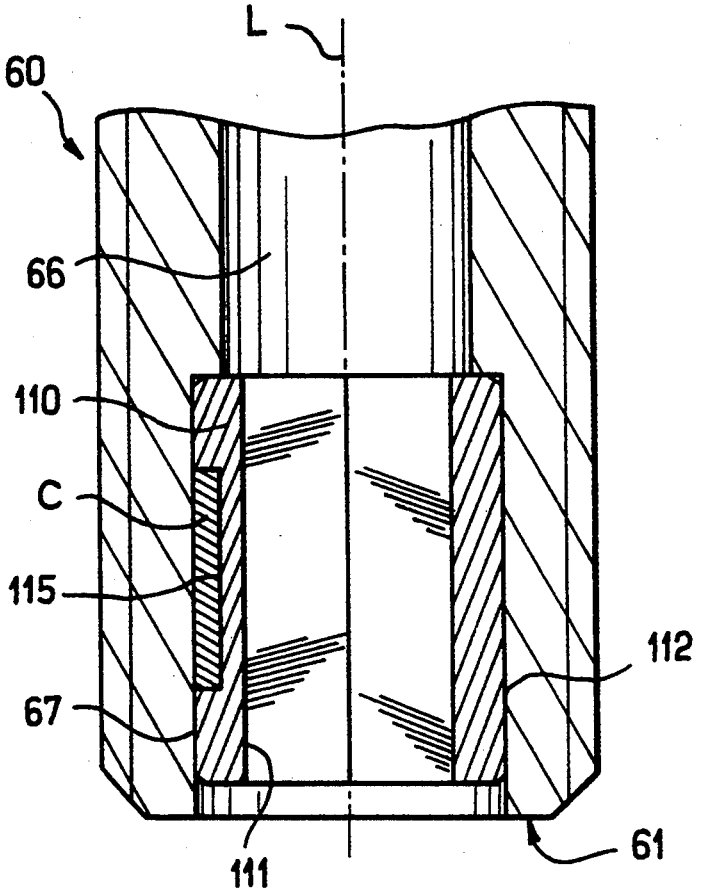
FIG. 5 is a large-scale longitudinal cross-sectional view showing the assembly of the sleeve inside the sheath.

In accordance with the invention, portion 50*a*, engaged in sheath 60, has a transverse cross-section of non-symmetrical revolution, preferably hexagonal as shown in FIG. 2. Reference will now be made in particular to FIGS. 3 to 5. Beside a central hole 66, cylindrical in revolution, serving for the passage of push rod 50, sheath 60 has a bore 67 emerging on its axial extremity 61 that receives a sleeve 110 coaxially arranged with respect to axis L, whose function is to rigidly lock in rotation push rod 50 and sheath 60 while at the same time allowing longitudinal displacement of push rod 50 inside sheath 60. For this purpose, sleeve 110 has an internal cross-section 111 of identical profile to that of portion 50*a* of the push rod. A perspective view of a sleeve 110 in accordance with the invention is shown in FIG. 3. The external surface of sleeve 110 is cylindrical in revolution and has hollowings 115 for housing a glue C in order to fix sleeve 110 in bore 67 of sheath 60. Advantageously, as shown, these hollowings are made up of three longitudinal flat parts formed on the external surface of sleeve 110 and which extend axially over only a part of the length of the sleeve. These flat parts are angularly distributed around the periphery of the sleeve, each extending angularly over an angular sector of approximately 60° and symmetrically either side of a transverse plane of symmetry P for the sleeve. Preferably, the sleeve is made from phenylene polysulphide and the glue used is an epoxy glue.

To mount sleeve 110 inside sheath 60, some glue 60 is arranged in hollowings 115 and then the sleeve introduced into bore 67 of sheath 60. Note that if the glue detaches from the sleeve, the function of rigid interlocking in rotation of the push rod and sheath will still be ensured for as long as the glue remains attached to bore 67 of sheath 60 by the wedging effect of the glue on hollowings 115 of sleeve 110. Note also that sleeve 110 is positioned in bore 67 slightly recessed from the axial extremity 61 of the sheath.

Figure 7:
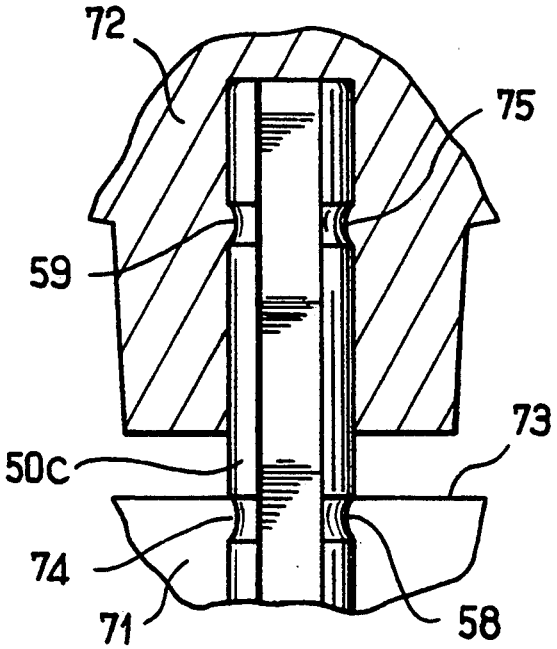
FIG. 7 is a view showing the assembly of the button on the push rod according to a first embodiment.

In the embodiment shown in FIGS. 1 and 7, the button 70 is made up of a rapid adjustment knob 71, coaxially arranged with respect to portion 50*c* of push rod 50, having means ensuring its rigid locking in rotation with the push rod, and a cover 72 mounted in free rotation on portion 50*c* of push rod 50, covering the axial extremity section 73 of the rapid adjustment knob 71 located opposite casing 10.

Figure 6:
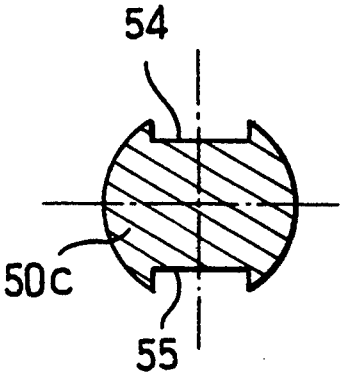
FIG. 6 is a transverse cross-section of the push rod along the line VI—VI of FIG. 1.

Preferably, as shown in FIGS. 6 and 7, the portion 50*c* has a transverse cross-section generally cylindrical in revolution, the means for rigidly locking in rotation knob 71 with push rod 50 being made up of two diametrically opposed longitudinal slots 54, 55 formed along the portion 50*c* of the push rod, said longitudinal slots 54, 55 engaging with longitudinal ribs of complementary shape protruding from the bearing surface of rapid adjustment knob 71. As shown in FIG. 7, portion 50*c* has two axially spaced annular grooves 58 and 59 which work respectively by complementarity of shapes with annular ribs 74 and 75 protruding from the bearing surfaces of fast adjustment knob 71 and cover 72, in order to axially retain them on portion 50*c* of push rod 50. Once mounted on portion 50*c* of push rod 50, the knob bears on the transverse shoulder of push rod 50 delimiting portions 50*b* and 50*c*. The role of cover 72, mounted free in rotation, is to prevent the push rod from turning and altering the volume to be dispensed when the operator pushes on it.

Figure 8:
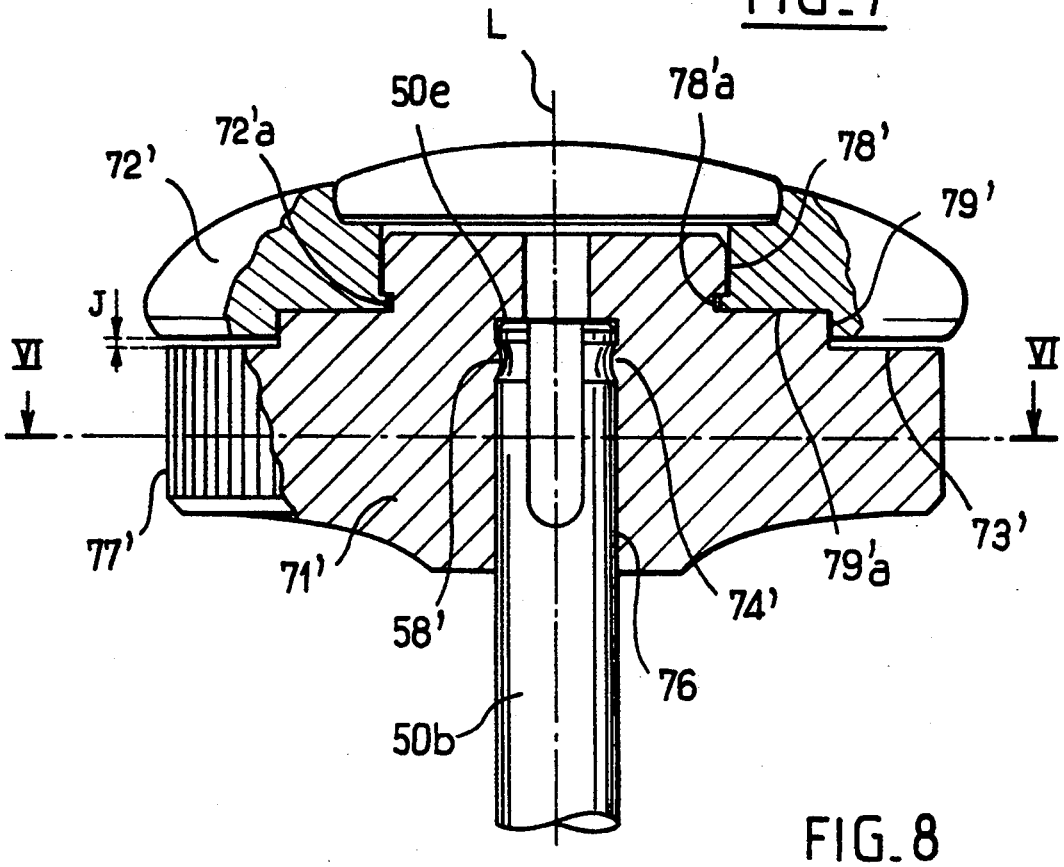
FIG. 8 is a longitudinal cross-sectional view of an alternative embodiment of the button according to the invention.

According to a variant, as shown in FIG. 8, the push rod only comprises staggered portions 50*a* and 50*b*, push button 70 being mounted at the free extremity of portion 50*b*, and the cover referenced 72' mounted free in rotation on the knob referenced 71'.

More precisely, the rapid adjustment knob 71' has an radially internal surface 76, serving as a bearing surface on portion 50*b*, and which is staggered so as to axially abut on the free extremity section 50*e* of portion 50*b*. Knob 71' is retained on the push rod by complementarity of shapes between an annular groove 58' provided on portion 50*b* and an annular rib 74' protruding from radially internal surface 76. Knob 71' is assembled on the push rod by inserting knob 71' on push rod 60 and the elastic forced crossing of the region of rod 50 located between annular groove 58' and the extremity section 50*e* by annular rib 74. Cover 72' is axially retained on knob 71' by complementarity of shapes. More precisely, as shown in FIG. 8, knob 71' has two staggered cylindrical portions 78' and 79' on its extremity section 73' situated opposite casing 10 which are symmetrical in revolution about longitudinal axis L. These two staggered cylindrical portions 78' and 79' serve as a bearing surface for the pivoting link between knob 71' and cover 72, the latter having two staggered internal surfaces that press against cylindrical portions 78' and 79'. Cylindrical portion 79' adjacent to the knurled radially external surface 77' of knob 71' rejoins cylindrical part 78' via a transverse shoulder 79'a on which cover 72' axially bears.

Cover 72' is axially retained on knob 71' by complementarity of shapes between an annular groove 78'a provided at the bottom of cylindrical part 78' adjacent to transverse shoulder 79'a and an annular rib 72'a projecting from the radially internal surface of cover 72'. Preferably, the assembly of cover 72' on knob 71' provides a clearance J between the transverse surface of the extremity section 73' adjacent to knurled surface 77' and the peripheral edge of cover 72', thus facilitating the free rotation of cover 72' on the knob 71'.

Finally, a pipette in accordance with the invention allows rapid adjustment of the volume to be dispensed, even by an operator wearing gloves, thanks to the coupling in rotation of push rod 50 and sheath 60 by sleeve 110.

We claim:

1. Pipette for sampling and dispensing adjustable volumes of liquid of the type comprising a pipette body extending along a longitudinal axis and a piston mounted in sliding fashion along this axis inside the said pipette body so as to define a chamber of variable volume emerging at a sampling orifice, said piston being driven over a limited distance of travel in the direction of the sampling orifice by means of pressure manually exerted on a push rod mounted in sliding fashion in the pipette body, and in the opposite direction by the reaction of elastic return means until the piston abuts against an axial extremity of a metal sheath extending along the said longitudinal axis inside the pipette body, the sheath having an external thread which works with a thread inside the pipette body in such a way as to move the sheath longitudinally when driven in rotation, in order to adjust the distance of travel of the piston in the opposite direction and the volume of the chamber, a first adjustment knob being secured to the sheath, and also the sheath intermeshing with means for displaying the volume to be dispensed, the push rod being mounted in sliding fashion in the sleeve, wherein:

the push rod has a non-symmetrical cross-section of revolution over at least a portion of its length, the sheath being rigidly locked by locking means to a sleeve arranged coaxially with respect to the sheath and in which the portion of the push rod with a non-symmetric cross-section of revolution is also engaged, the sleeve having an internal profile complementary or homologous to the said portion of the push rod so as to rigidly lock the push rod and sheath in rotation while allowing the push rod to move longitudinally inside the sheath to provide rapid adjustment of the volume to be dispensed.

2. The pipette of claim 1 wherein the sleeve is glued inside the sheath.

3. The pipette of claim 1 wherein the sleeve is received in a bore emerging on the axial extremity of the sheath serving as a distance of travel end stop in the reverse direction of the piston, the radially external face of the sleeve having hollowings to house fixing glue in the bore of the sheath.

4. The pipette of claim 1 wherein the push rod has a portion located outside the pipette body having a button comprising a second adjustment knob with means for rigidly locking the second adjustment knob in rotation with the said push rod and a cover mounted free in rotation about the said longitudinal axis which covers the axial extremity section of the knob located opposite the pipette body.

5. The pipette of claim 1 wherein the said cross-section of the portion of the push rod which is non-symmetrical in revolution engaged in the sleeve is hexagonal.

6. The pipette of claim 1 wherein the sleeve is made from phenylene polysulphide.

7. The pipette of claim 1 wherein the sleeve is glued inside the sheath and the glue is an epoxy glue.

8. Pipette for sampling and dispensing adjustable volumes-of liquid of the type comprising a pipette body extending along a longitudinal axis and a piston mounted in sliding fashion along this axis inside the said pipette body so as to define a chamber of variable volume emerging at a sampling orifice, said piston being driven over a limited distance of travel in the direction of the sampling orifice by means of pressure manually exerted on a push rod mounted in sliding fashion in the pipette body, and in the opposite direction by the reaction of elastic return means until the piston abuts against an axial extremity of a metal sheath extending along the said longitudinal axis inside the pipette body, the sheath having an external thread which works with a thread inside the pipette body in such a way as to move the sheath longitudinally when driven in rotation, in order to adjust the distance of travel of the piston in the opposite direction and the volume of the chamber, a first adjustment knob being secured to the sheath, and the sheath also intermeshing with means for displaying the volume to be dispensed, the push rod being mounted in sliding fashion in the sleeve, wherein the push rod has a non-symmetrical cross-section of revolution over at least a portion of its length, the sheath being rigidly locked by locking means to a sleeve arranged coaxially with respect to the sheath and in which the portion of the push rod with a non-symmetric cross-section of revolution is also engaged, the sleeve having an internal profile complementary or homologous to the said portion of the push rod so as to rigidly lock the push rod and sheath in rotation while allowing the push rod to move longitudinally inside the sheath to provide rapid adjustment of the volume to be dispensed, wherein the push rod has a portion located outside the pipette body having a button comprising a second adjustment knob with means for rigidly locking said second adjustment knob it in rotation with the said push rod and a cover mounted free in rotation about the said longitudinal axis which covers the axial extremity section of the 5 knob located opposite the pipette body, and wherein the means for rigidly locking the second adjustment knob in rotation with the push rod comprise two longitudinal slots formed on two diametrically opposed sides of the push rod and which engage with two projecting ribs of complementary profile on the bearing surface of the second adjustment knob.

9. The pipette of claim 8 wherein the cover is mounted free in rotation on the push rod and held axially onto it by complementarity of shapes.

10. The pipette of claim 8 wherein the cover is mounted free in rotation on the second adjustement knob and held axially onto it by complementarity of shapes.

11. Pipette for sampling and dispensing adjustable volumes of liquid of the type comprising a pipette body extending along a longitudinal axis and a piston mounted in sliding fashion along this axis inside the said pipette body so as to define a chamber of variable volume emerging at a sampling orifice, said piston being driven over a limited distance of travel in the direction of the sampling orifice by means of pressure manually exerted on a push rod mounted in sliding fashion in the pipette body, and in the opposite direction by the reaction of elastic return means until the piston abuts against an axial extremity of a metal sheath extending along the said longitudinal axis inside the pipette body, the sheath having an external thread which works with a thread inside the pipette body in such a way as to move the sheath longitudinally when driven in rotation, in order to adjust the distance of travel of the piston in the opposite direction and the volume of the chamber, a first adjustment knob being secured to the sheath, and also the sheath intermeshing with means for displaying the volume to be dispensed, the push rod being mounted in sliding fashion in the sleeve, wherein the push rod has a non-symmetrical cross-section of revolution over at least a portion of its length, the sheath being rigidly locked by locking means to a sleeve arranged coaxially with respect to the sheath and in which the portion of the push rod with a non-symmetric cross-section of revolution is also engaged, the sleeve having an internal profile complementary or homologous to the said portion of the push rod so as to rigidly lock the push rod and sheath in rotation while allowing the push rod to move longitudinally inside the sheath to provide rapid adjustment of the volume to be dispensed, wherein the sleeve is received in a bore emerging on the axial extremity of the sheath as a distance of travel end stop in the reverse direction of the piston, the radially external face of the sleeve having hollowings to house fixing glue in the bore of the sheath; and wherein the said hollowings provided on the external surface of the sleeve are made up of longitudinal flat parts extending axially over only a 5 portion of the length of the sleeve.

12. The pipette of claim 11 wherein these hollowings are made of three longitudinal flat parts equally distributed angularly about a longitudinal axis of symmetry for the sleeve and symmetrically extending axially either side of a transverse plane of symmetry P for the sleeve.

13. Pipette for sampling and dispensing adjustable volumes of liquid of the type comprising a pipette body extending along a longitudinal axis and a piston mounted in sliding fashion along this axis inside the said pipette body so as to define a chamber of variable volume emerging at a sampling orifice, said piston being driven over a limited distance of travel in the direction of the sampling orifice by means of pressure manually exerted on a push rod mounted in sliding fashion on the pipette body, and in the opposite direction by the reaction of elastic return means until the piston abuts against an axial extremity of a metal sheath extending along the said longitudinal axis inside the pipette body, the sheath having an external thread which works with a thread inside the pipette body in such a way as to move the sheath longitudinally when driven in rotation, in order to adjust the distance of travel of the piston in the opposite direction and the volume of the chamber, a first adjustment knob being secured to the sheath, and the sheath also intermeshing with means for displaying the volume to be dispensed, the push rod being mounted in sliding fashion in the sleeve, wherein:

the push rod has non-symmetrical cross section of revolution over at least a portion of its length, the sheath being rigidly locked by locking means to a sleeve arranged coaxially with respect to the sheath and in which the portion of the push rod with a non-symmetric cross-section of revolution is also engaged, the sleeve having an internal profile complementary or homologous to the said portion of the push rod so as to rigidly lock the push rod and sheath in rotation while allowing the push rod to move longitudinally inside the sheath to provide rapid adjustment of the volume to be dispensed, and wherein the sleeve is received in a bore emerging on the axial extremity of the sheath serving as a distance of travel end stop in the reverse direction of the piston, the radially external face of the sleeve having hollowings to house fixing glue in the bore of the sheath.

14. Pipette for sampling and dispensing adjustable volumes of liquid of the type comprising a pipette body extending along a longitudinal axis and a piston mounted in sliding fashion along this axis inside the said pipette body so as to define a chamber of variable volume emerging at a sampling orifice, said piston being driven over a limited distance of travel in the direction of the sampling orifice by means of pressure manually exerted on a push rod mounted in sliding fashion in the pipette body, and in the opposite direction by the reaction of elastic return means until the piston abuts against an axial extremity of a metal sheath extending along the said longitudinal axis inside the pipette body, the sheath having an external thread which works with a thread inside the pipette body in such a way as to move the sheath longitudinally when driven in rotation, in order to adjust the distance of travel of the piston in the opposite direction and the volume of the chamber, a first adjustment knob being secured to the sheath, and the sheath also intermeshing with means for displaying the volume to be dispensed, the push rod being mounted in sliding fashion in the sleeve, wherein:

the push rod has non-symmetrical cross section of revolution over at least a portion of its length, the sheath being rigidly locked by locking means to a sleeve arranged coaxially with respect to the sheath and in which the portion of the push rod with a non-symmetric cross-section of revolution is also engaged, the sleeve having an internal profile complementary or homologous to the said portion of the push rod so as to rigidly lock the push rod and sheath in rotation while allowing the push rod to move longitudinally inside the sheath to provide rapid adjustment of the volume to be dispensed, and wherein the push rod has a portion located outside the pipette body having a button comprising a second adjustment knob with means for rigidly locking the second adjustment knob in rotation with the said push rod and a cover mounted free in rotation about the said longitudinal axis which covers the axial extremity section of the knob located opposite the pipette body.

15. Pipette for sampling and dispensing adjustable volumes of liquid of the type comprising a pipette body extending along a longitudinal axis and a piston mounted in sliding fashion along this axis inside the said pipette body so as to define a chamber of variable volume emerging at a sampling orifice, said piston being driven over a limited distance of travel in the direction of the sampling orifice by means of pressure manually exerted on a push rod mounted in sliding fashion in the pipette body, and in the opposite direction by the reaction of elastic return means until the piston abuts against an axial extremity of a metal sheath extending along the said longitudinal axis inside the pipette body, the sheath having an external thread which works with a thread inside the pipette body in such a way as to move the sheath longitudinally when driven in rotation, in order to adjust the distance of travel of the piston in the opposite direction and the volume of the chamber, a first adjustment knob being secured to the sheath, and the sheath also intermeshing with means for displaying the volume to be dispensed, the push rod being mounted in sliding fashion in the sleeve, wherein:

the push rod has non-symmetrical cross section of revolution over at least a portion of its length, the sheath being rigidly locked by locking means to a sleeve arranged coaxially with respect to the sheath and in which the portion of the push rod with a non-symmetric cross-section of revolution is also engaged, the sleeve having an internal profile complementary or homologous to the said portion of the push rod so as to rigidly lock the push rod and sheath in rotation while allowing the push rod to move longitudinally inside the sheath to provide rapid adjustment of the volume to be dispensed, wherein the push rod has a portion located outside the pipette body having a button comprising a second adjustment knob with means for rigidly locking the second adjustment knob in rotation with the said push rod and a cover mounted free in rotation about the said longitudinal axis which covers the axial extremity section of the knob located opposite the pipette body, and wherein the means for rigidly locking the second adjustment knob in rotation with the push rod comprise two longitudinal slots formed on two diametrically opposite sides of the push rod and which engage with two projecting ribs of complementary profile on the bearing surface of the second adjustment knob, and wherein the cover is mounted free in rotation on the push rod and held axially onto it by complementarity of shapes.

16. Pipette for sampling and dispensing adjustable volumes of liquid of the type comprising a pipette body extending along a longitudinal axis and a piston mounted in sliding fashion along this axis inside the said pipette body so as to define a chamber of variable volume emerging at a sampling orifice, said piston being driven over a limited distance of travel in the direction of the sampling orifice by means of pressure manually exerted on a push rod mounted in sliding fashion in the pipette body, and in the opposite direction by the reaction of elastic return means until the piston abuts against an axial extremity of a metal sheath extending along the said longitudinal axis inside the pipette body, the sheath having an external thread which works with a thread inside the pipette body in such a way as to move the sheath longitudinally when driven in rotation, in order to adjust the distance of travel of the piston in the opposite direction and the volume of the chamber, a first adjustment knob being secured to the sheath, and the sheath also intermeshing with means for displaying the volume to be dispensed, the push rod being mounted in sliding fashion in the sleeve, wherein:

the push rod has non-symmetrical cross section of revolution over at least a portion of its length, the sheath being rigidly locked by locking means to a sleeve arranged coaxially with respect to the sheath and in which the portion of the push rod with a non-symmetric cross-section of revolution is also engaged, the sleeve having an internal profile complementary or homologous to the said portion of the push rod so as to rigidly lock the push rod and sheath in rotation while allowing the push rod to move longitudinally inside the sheath to provide rapid adjustment of the volume to be dispensed, wherein the push rod has a portion located outside the pipette body having a button comprising a second adjustment knob with means for rigidly locking the second adjustment knob in rotation with the said push rod and a cover mounted free in rotation about the said longitudinal axis which covers the axial extremity section of the knob located opposite the pipette body, wherein the means for rigidly locking the second adjustment knob in rotation with the push rod comprise two longitudinal slots formed on two diametrically opposed sides of the push rod and which engage with two projecting ribs of complementary profile on the bearing surface of the second adjustment knob and held axially onto it by complementarity of shapes.

* * * * *

UNITED STATES PATENT AND TRADEMARK OFFICE

CERTIFICATE OF CORRECTION

PATENT NO. : 5,413,006
APPLICATION NO. : 08/128370
DATED : May 9, 1995
INVENTOR(S) : D'Autry It is certified that error appears in the above-identified patent and that said Letters Patent is hereby corrected as shown below:

Claim 1:
Please replace "the sleeve" at Column 7, Line 6 with --a sleeve--.
Please replace "a sleeve" at Column 7, Lines 9-10 with --the sleeve--.

Claim 8:
Please replace "the sleeve" at Column 7, Line 64 with --a sleeve--.
Please replace "a sleeve" at Column 7, Line 68 with --the sleeve--.
Please delete extraneous number "5" at Column 8, Line 16.

Claim 11:
Please replace "the sleeve" at Column 8, Line 53 with --a sleeve--.
Please replace "a sleeve" at Column 8, Line 57 with --the sleeve--.
Please delete extraneous number "5" at Column 9, Line 7.

Claim 14:
Please replace "the sleeve" at Column 10, Line 8 with --a sleeve--.
Please replace "a sleeve" at Column 10, Lines 11-12 with --the sleeve--.

Claim 15:
Please replace "the sleeve" at Column 10, Line 51 with --a sleeve--.
Please replace "a sleeve" at Column 10, Lines 54-55 with --the sleeve--.

Claim 16:
Please replace "the sleeve" at Column 12, Line 2 with --a sleeve--.
Please replace "a sleeve" at Column 12, Lines 5-6 with --the sleeve--.

Signed and Sealed this

Third Day of February, 2009

JOHN DOLL
*Acting Director of the United States Patent and Trademark Office*